US009199696B1

(12) United States Patent
Bonell

(10) Patent No.: US 9,199,696 B1
(45) Date of Patent: Dec. 1, 2015

(54) TEMPORARY MOORING DEVICE FOR SMALL MARINE VESSELS AND METHODS OF USE

(71) Applicant: Brian Paul Bonell, Englewood, CO (US)

(72) Inventor: Brian Paul Bonell, Englewood, CO (US)

( * ) Notice: Subject to any disclaimer, the term of this patent is extended or adjusted under 35 U.S.C. 154(b) by 118 days.

(21) Appl. No.: 13/854,767

(22) Filed: Apr. 1, 2013

Related U.S. Application Data

(60) Provisional application No. 61/686,194, filed on Apr. 2, 2012.

(51) Int. Cl.
*B63B 21/00* (2006.01)
*B63B 21/20* (2006.01)

(52) U.S. Cl.
CPC ..... *B63B 21/20* (2013.01)

(58) Field of Classification Search
CPC .. B63B 21/20; B63B 21/00; B63B 2021/003; B63B 22/02; B63B 2021/006
USPC ..... 114/230.1, 230.2, 230.22, 230.26, 242, 114/249; 441/40, 129
See application file for complete search history.

(56) References Cited

U.S. PATENT DOCUMENTS

| | | | | |
|---|---|---|---|---|
| 3,322,091 | A * | 5/1967 | Stanwick | 114/242 |
| 3,345,971 | A * | 10/1967 | Stanwick | 114/242 |
| 4,583,343 | A * | 4/1986 | Camp | 52/749.11 |
| 4,721,487 | A * | 1/1988 | Cochran | 441/80 |
| 4,729,331 | A * | 3/1988 | Eggleston | 114/230.26 |
| 4,775,346 | A * | 10/1988 | Gunter et al. | 441/129 |
| D364,595 | S * | 11/1995 | Doyle | D12/168 |
| 6,154,929 | A | 12/2000 | Dwyer | |
| 7,867,049 | B1 * | 1/2011 | Doffay | 441/40 |
| 2011/0252692 | A1 * | 10/2011 | Sim | 43/44.84 |

* cited by examiner

*Primary Examiner* — Anthony Wiest
(74) *Attorney, Agent, or Firm* — Glenn E. Gold; Gold & Rizvi, P.A.

(57) ABSTRACT

A temporary mooring device for securing a small marine vessel to a substantially smooth surface includes first and second selectively engagable suction cups, a line extending between and connecting the suction cups one to the other and a selectively releasable link positioned on the line intermediate to the two suction cups for securing to the vessel.

8 Claims, 7 Drawing Sheets

TEMPORARY MOORING DEVICE FOR SMALL MARINE VESSELS AND METHODS OF USE

CROSS-REFERENCE TO RELATED APPLICATION

This Non-Provisional Utility application claims the benefit of U.S. Provisional Patent Application Ser. No. 61/686,194, filed on Apr. 2, 2012, which is incorporated herein in its entirety.

FIELD OF THE INVENTION

The present disclosure generally relates to apparatuses and methods for temporary mooring of boats. More particularly, the present disclosure relates to a method and device to temporarily moor a small boat to the hull of a larger marine vessel.

BACKGROUND OF THE INVENTION

Marine craft are available in a wide variety of sizes beginning with dinghies which are small boats often carried or towed for use as a ship's boat by a larger vessel. Dinghies generally are configured as rowboats or have an outboard motor and usually range in size from six to twenty feet in length. Many modern dinghies are made of synthetic materials and can be either rigid, semi-rigid, or inflatable. Whatever the construction, a dinghy is typically used to accompany and to tend to tasks surrounding a larger host vessel.

While some dinghies are stowed onboard the larger vessel when not being manned for a particular task at hand, other dinghies are secured or moored to the host vessel and towed when the size of the host vessel is not significantly larger than the dinghy. In such instances, the dinghy would occupy excessive deck space on the host vessel. Thus, a dinghy will typically exhibit a significantly smaller freeboard than that of the host vessel. This disparity in freeboard can pose a problem when trying to moor the dinghy to the larger host vessel. The operator of the dinghy may have difficulty reaching the gunwales of the larger vessel to properly moor the dinghy unless there is another person on the host vessel to assist. Since the host vessel will typically not have cleats or other hard points on the outside of the hull, the operator of the dinghy may be in a quandary with respect to securing, even temporarily, the dinghy to the host vessel.

Also, a dinghy is often used as a platform from which the outer surface of the host vessel hull is maintained such as by cleaning or polishing. Using the dinghy permits the maintenance personnel to work substantially in an upright position even when working close to the waterline of the host vessel as opposed to attempting to reach the sides of the hull from the deck of the host vessel. These maintenance actions also require the application of a certain degree of force or pressure to the host vessel hull by the individuals performing the work. In those instances, unless the dinghy is secured to the host vessel, the force applied by the individual will merely push the dinghy away from the host vessel as a result of Newton's Third Law of Motion which posits that for every action, there is an equal and opposite reaction. Thus, unless the dinghy can be securely moored to the host vessel, the efforts of the individuals to perform the various maintenance tasks are often thwarted.

Therefore, there is a need for a device to permit a temporary and secure mooring by a small boat to a larger vessel operable by a single individual. There is also a further need for the device to facilitate the mooring of the smaller craft to and movable along an entire length of the hull of the host vessel so that the entire surface area of the host vessel hull can be accessed by the personnel performing maintenance.

SUMMARY OF THE INVENTION

The present disclosure is generally directed to a temporary mooring device for securing a small marine vessel to a substantially smooth surface. The temporary mooring device includes first and second selectively engagable suction cups and a line extending between and connecting the first suction cup to the second suction cup.

In another aspect, the line is a shock cord.

In still another aspect, the device further includes a selectively engagable link engaging the line intermediate between the first and second suction cups.

In yet another aspect, the device further includes a swivel engaging the line intermediate between the first and second suction cups and further wherein the swivel is positioned intermediate between the line and the selectively engagable link such that the selectively engagable link is pivotal with respect to the line.

In a still further aspect, the device further includes a first tube segment sleeved over and closely engaging the line proximate to a first side of the swivel and a second tube segment sleeved over and closely engaging the line proximate to a second side of the swivel.

In another aspect, the first and second tube segments are repositionable along a length of said line for selectively repositioning the swivel with respect to the first and second suction cups.

In another aspect, the selectively engagable link is a carabiner.

In a still further aspect, at least one of the selectively engagable suction cups is formed as a pistol grip and includes a lever for selectively engaging the suction cup.

In yet another aspect, the lever of the pistol grip suction cup is normally biased to a disengaged state and further wherein operation of the lever selectively engages the suction cup to secure the suction cup to the substantially smooth surface.

In another aspect, a method for temporarily mooring a small marine vessel to a substantially smooth surface includes providing at least a first temporary mooring device of the type having a first and a second selectively engagable suction cup, a shock cord interconnecting the suction cups one with the other, a swivel engaged on the shock cord intermediate between the suction cups and selectively maintained in an intermediate position by first and second tube segments closely engaging the shock cord on opposing sides of the swivel, and a selectively engagable link engaged with the swivel and pivotal with respect to the shock cord. The selectively engagable link is engaged with an element of the small marine vessel to be moored, and a first of the suction cups is placed against the substantially smooth surface to which the small marine vessel is to be moored. The first suction cup is activated to secure the first suction cup to the substantially smooth surface, and the second of the suction cups is placed against the substantially smooth surface to which the small marine vessel is to be moored. The second suction cup is then activated to secure the second suction cup to the substantially smooth surface.

In still another aspect, the method includes providing a second like mooring device wherein the selectively engagable link of the second mooring device is engaged with an element of the small marine vessel distal from the first mooring device. A first of the suction cups of the second mooring device is placed against the substantially smooth surface to which the small marine vessel is to be moored, and the first suction cup is activated to secure the first suction cup to the substantially smooth surface. A second of the suction cups of the second mooring device is placed against the substantially smooth surface to which the small marine vessel is to be moored, and the second suction cup is activated to secure the second suction cup to the substantially smooth surface.

In yet another aspect, the method includes sliding a first of the tube segments along at least a partial length of the shock cord and translating the swivel along the shock cord to substantially abut the first tube segment. The second of the tube segments is slid along the length of the shock cord to substantially abut the swivel.

In another aspect, a method of translating a small marine vessel along a substantially smooth surface includes providing a first and a second temporary mooring device of the type having a first and a second selectively engagable suction cup and a line interconnecting the suction cups one with the other. The line of the first mooring device is secured to the bow of the small vessel, and the first and second suction cups of the first mooring device are affixed to the surface in a laterally spaced apart configuration. The line of the second mooring device is secured to the stern of the small vessel, and the first and second suction cups of the second mooring device are affixed to the surface in a laterally spaced apart configuration. The first of the suction cups of the first mooring device is released from the surface and is then laterally translated along the surface in a manner to leap-frog the second suction cup to a position laterally spaced from the second suction cup on an opposite side of the second suction cup. The first suction cup of the first mooring device is re-affixed to the surface. The first of the suction cups of the second mooring device is then released from the surface and is laterally translated along the surface in a manner to leap-frog the second suction cup to be laterally spaced from the second suction cup on an opposite side of the second suction cup. The first suction cup of the second mooring device is then re-affixed to the surface.

In still another aspect, the method further includes repeating the alternating leap-frog translations utilizing the second suctions cups of the first and second mooring devices.

In yet another aspect, the line is a shock cord.

In a still further aspect, each provided temporary mooring device includes a selectively releasable link engaging the line at a location intermediate the first and second suction cups.

In another aspect, the selectively releasable link is a carabiner.

In another aspect, the selectively releasable link secures the line to the small marine vessel.

In a still further aspect, each provided temporary mooring device includes a swivel engaged on the line intermediate between the first and second suction cups and further wherein the selectively releasable link engages the swivel and is pivotal with respect to the line.

In yet another aspect, the swivel is selectively maintained in an intermediate position by first and second tube segments closely engaging the line on opposing sides of the swivel.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
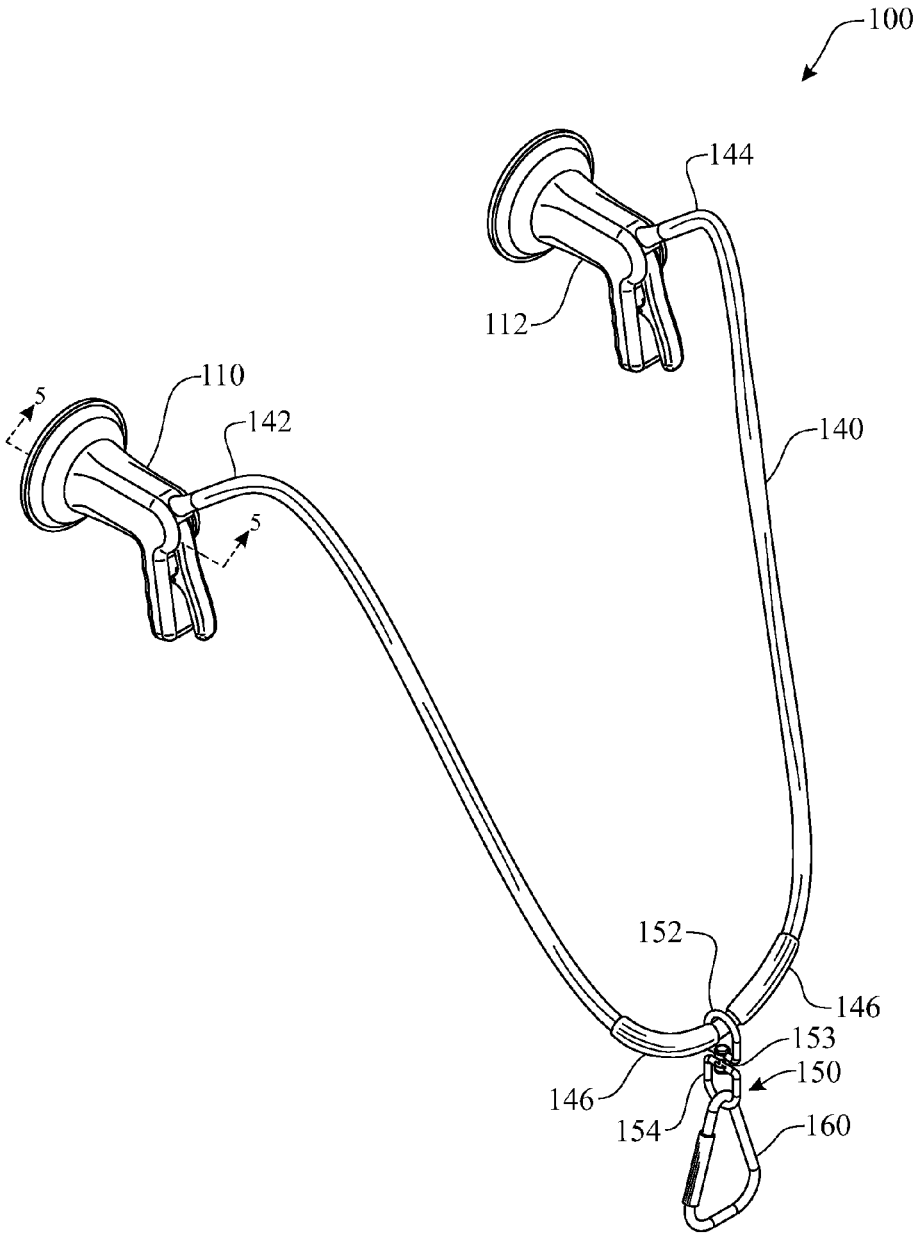
FIG. 1 presents a perspective view of a temporary mooring device embodying the present invention, wherein two pistol grip suction cups are interconnected by a resilient shock cord.

In one exemplary implementation of the invention, a temporary mooring device 100 is shown in FIG. 1 illustrating its various components where the device 100 includes first and second selectively engageable suction cups 110, 112 interconnected by a length of line 140 extending between the suction cups 110, 112. The line 140 can be a marine grade of braided line, or more preferably is a length of elastically resilient shock cord, also known as bungee cord.

The line 140 has a first end 142 affixed to a first selectably engageable suction cup 110 and a second end 144 affixed to a second selectably engageable suction cup 112. Suction cups 110 and 112 are substantially identically constructed suction cups. Line ends 142, 144 are affixed to the suction cups 110, 112 at a point distal from the suction cup interface with a substantially smooth surface to which the mooring device 100 is to be attached. The selection of this attach point facilitates directing any force applied by the line 140 on the suction cups 110, 112, as primarily a tensile force applied to the suction cup interface with the surface to which it is to be attached. The attach points are preferably affixed to a position on the suction cups 110, 112 such that the angle of the line 140 is configured so as not to pull on the suction cups 110, 112 with sufficient force to significantly reduce the hold of the suction cups 110, 112 on a surface.

A swivel 150 generally comprises a first ring 152, a second ring 154 and a coupling 153 disposed between and pivotally connected to each of the first and second rings 152, 154 so as to permit substantially free rotation of either one of the first and second rings 152, 154 with respect to the other of the first and second rings 152, 154 in a manner well known in the industry. The first ring 152 is slidably engaged upon line 140 in a manner that permits the swivel 150 to freely translate the length of line 140. The swivel 150 can be positionally secured at a position along the length of line 140 located generally intermediate between the opposite ends 142, 144 thereof, with a tube segment 146 sleeved over and closely received by the line 140 so as to circumscribe, or co-axially surround, the line 140 adjacent to, and for substantially abutting, each of the opposite sides of the swivel 150. The outer diameter of the tube segments 146 being larger than the inner diameter of the ring 152 of the swivel 150 thereby prevents undesired translation of the swivel 150 along the length of line 140 other than the portion of the line 140 extending between the tube segments 146. The tube segments 146 may be configured in a well-known manner in the industry to allow the tube segments 146 to act as a flotation device, to prevent loss of the mooring device 100 in the event that the mooring device 100 is dropped into the water.

A selectively engagable link 160 is engaged with the second ring 154 of the swivel 150. The link 160 in a most preferable configuration is a carabiner and well known in the industry. In this manner, the engagable link 160 can freely rotate with respect to the line 140. Those practiced in the art will recognize that the swivel 150 can be eliminated and the engagable link 160 is then directly engaged upon line 140, albeit at the sacrifice of the free rotation facilitated by the swivel 150.

Figure 2:
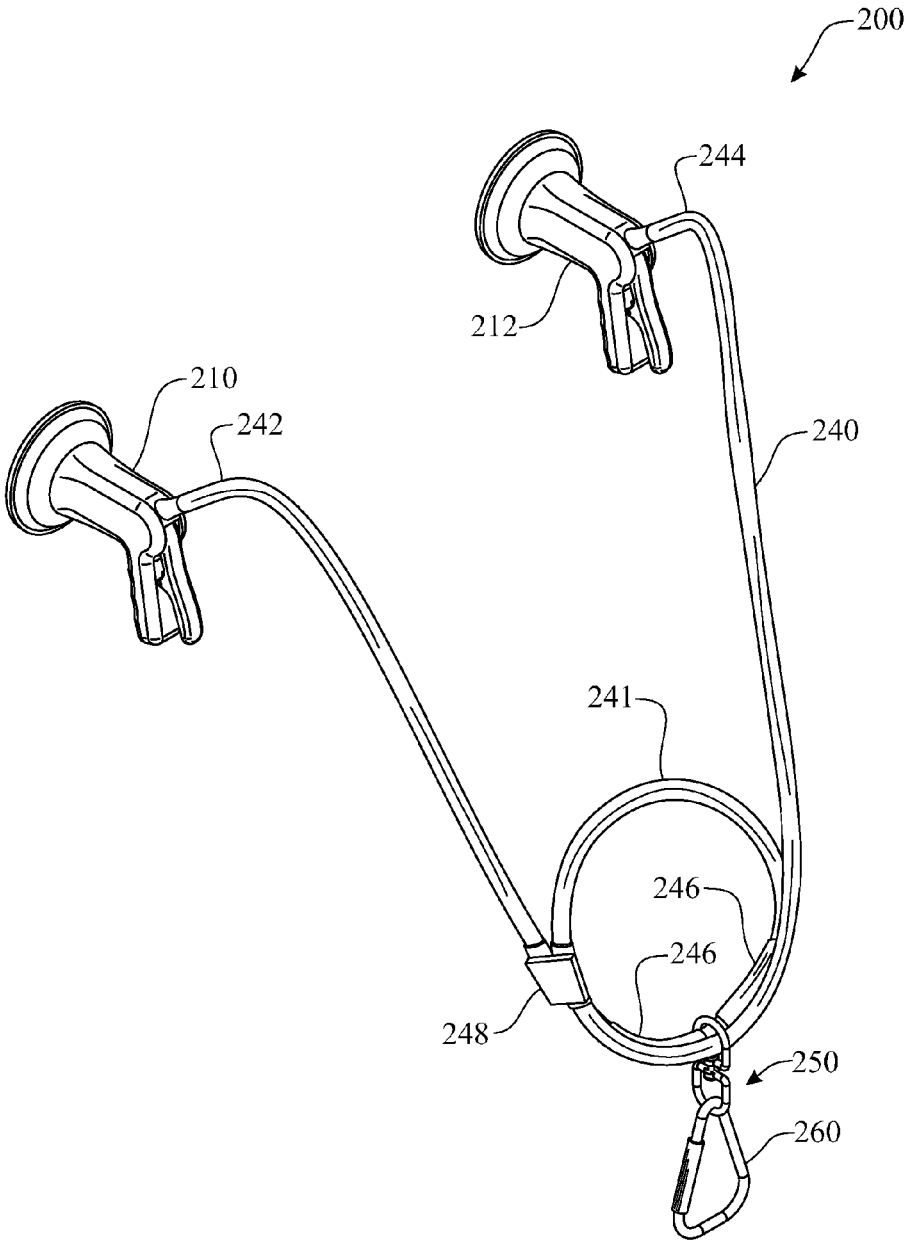
FIG. 2 presents an alternate embodiment temporary mooring device wherein an intermediate portion of the line is formed in a loop.

A second embodiment temporary mooring device 200 is illustrated in FIG. 2 wherein like elements corresponding to the elements of device 100 in FIG. 1 are like numbered and preceded by the numeral "2". The temporary mooring device 200 includes first and second suction cups 210 and 212 interconnected by a line 240 having first and second ends 242, 244 respectively affixed to the suction cups 210, 212. A swivel 250 is positioned intermediately along the length of line 240 by the tube segments 246 abutting opposite sides of the swivel 250. A selectively engagable link 260 is engaged with the swivel 250 and is rotatable with respect to the line 240. However, the mooring device 200 is characterized by the line 240 forming a loop 241 at the swivel 250. The loop 241 formed from the line 240 is maintained by a slide 248 closely engaging the beginning and the end of loop 241 thereby maintaining a desired configuration of the loop 241. The slide 248 facilitates the adjustment of the length of the line 240. In other words, the slide 248 and the loop 241 aid in allowing a user to select the optimal distance from a dinghy 190 to a host vessel 198. The user may pull or push the loop 241 through the slide 248 in order to increase or decrease the radius of the loop 241 such that the distance from the dinghy 190 to the host vessel 198 is selectively adjusted. This is particularly advantageous when the mooring device 100 is attached to a curved portion of a hull 199, such as the fore or aft of the hull 199 of some host vessels 198. In such a configuration, one side of the line 241 may be required to be longer or shorter than the opposing side of the line 241, due to the curved body of the hull 199 at such configuration.

Figure 5:
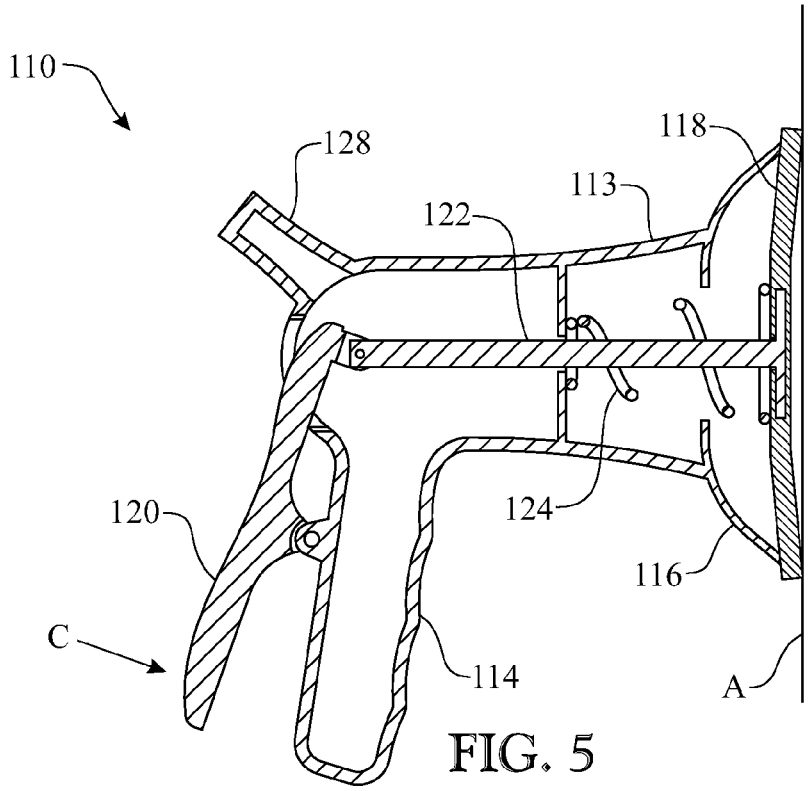
FIG. 5 presents a cross-sectional view of an unengaged pistol grip suction cup of the temporary mooring device shown in FIG. 1 and taken along the line 5-5, FIG. 1.
Figure 6:
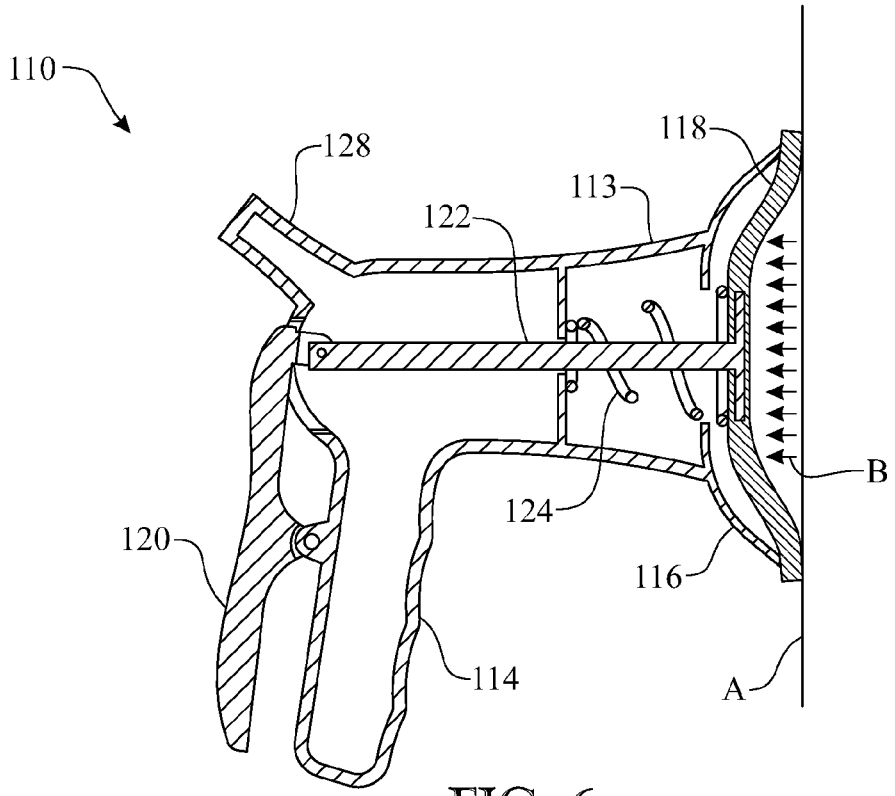
FIG. 6 presents a cross-sectional view of an engaged pistol grip suction cup of FIG. 4 of the temporary mooring device and secured to the outer hull of the host vessel.

Referring now to FIGS. 5-6, the selectably engageable suction cup 110 is shown in cross-section to illustrate its construction and operation for operable engagement with a substantially smooth surface "A." The suction cup 110 is constructed with a body 113 having a base 116 and a pistol grip 114 at an end distal from the base 116. An attach point 128 for the line 140 (not shown) is also positioned on the body 113 at an end thereof distal from the base 116. An operating lever 120 is pivotally affixed to pistol grip 114 and is operably connected to a piston-like rod 122 extending through the body 113 terminating within the area circumscribed by the base 116. The piston-like rod 122 is affixed to a flexible resilient layer 118 in a manner such that longitudinal translation of the piston-like rod 122 causes a central portion of the resilient layer 118 to be drawn into the base 116. The central portion of the resilient layer 118 and the piston-like rod 122 are biased toward the bottom of the base 116 by a compression spring 124.

In operation, and as initially illustrated in FIG. 5, the suction cup 110 is placed on the substantially smooth surface "A" such that the resilient layer 118 is in a relaxed state, abutting the surface "A." The suction cup 110 is pushed toward the surface "A" to provide maximum contact of the resilient layer 118 with the surface "A." Then, as illustrated in FIG. 6, the operating lever 120 is pivoted by a force "C" (FIG. 5) in a manner to translate the piston-like rod 122 in the body 113 in opposition to the biasing force of the compression spring 124 (arrows "B" of FIG. 6) thereby drawing the central portion of the resilient layer 118 into the base 116 and creating a void between surface "A" and the resilient layer 118. The smoothness of surface "A" and the resilience of layer 118 combine to effectively seal the void from the ambient air pressure thus creating a vacuum in the void. This differential air pressure maintains the suction cup 110 in engagement with the surface "A" until the operating lever 120 is released from its operable position and the biasing spring 124 is permitted to return the resilient layer 118 to its relaxed state thereby releasing the suction cup 110 from engagement with the surface "A."

Figure 3:
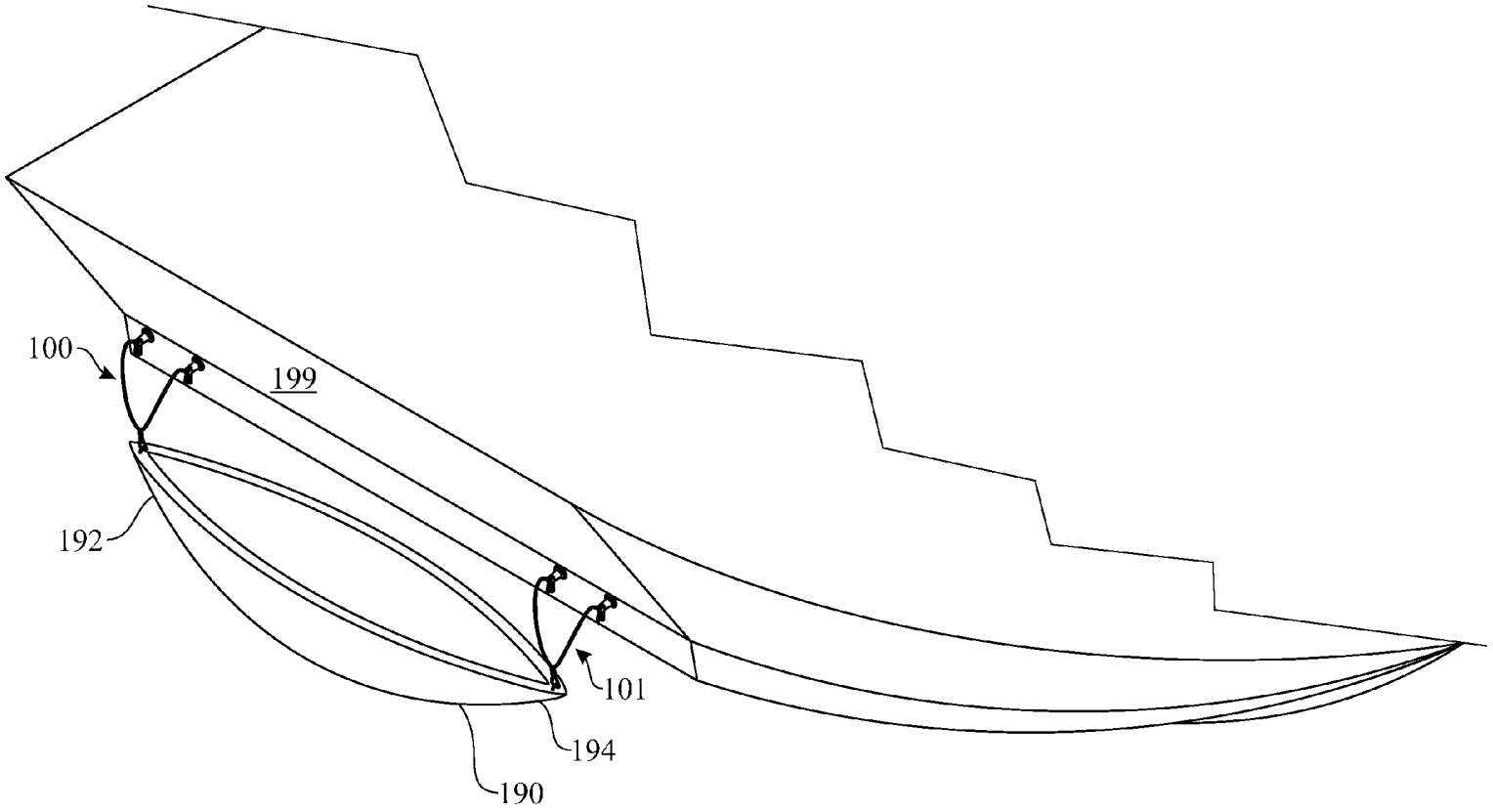
FIG. 3 presents a perspective schematic view of a dinghy temporarily moored to a host vessel utilizing the device of FIG. 1 to moor the bow of the dinghy and the stern of the dinghy to the hull of the host vessel.
Figure 4:
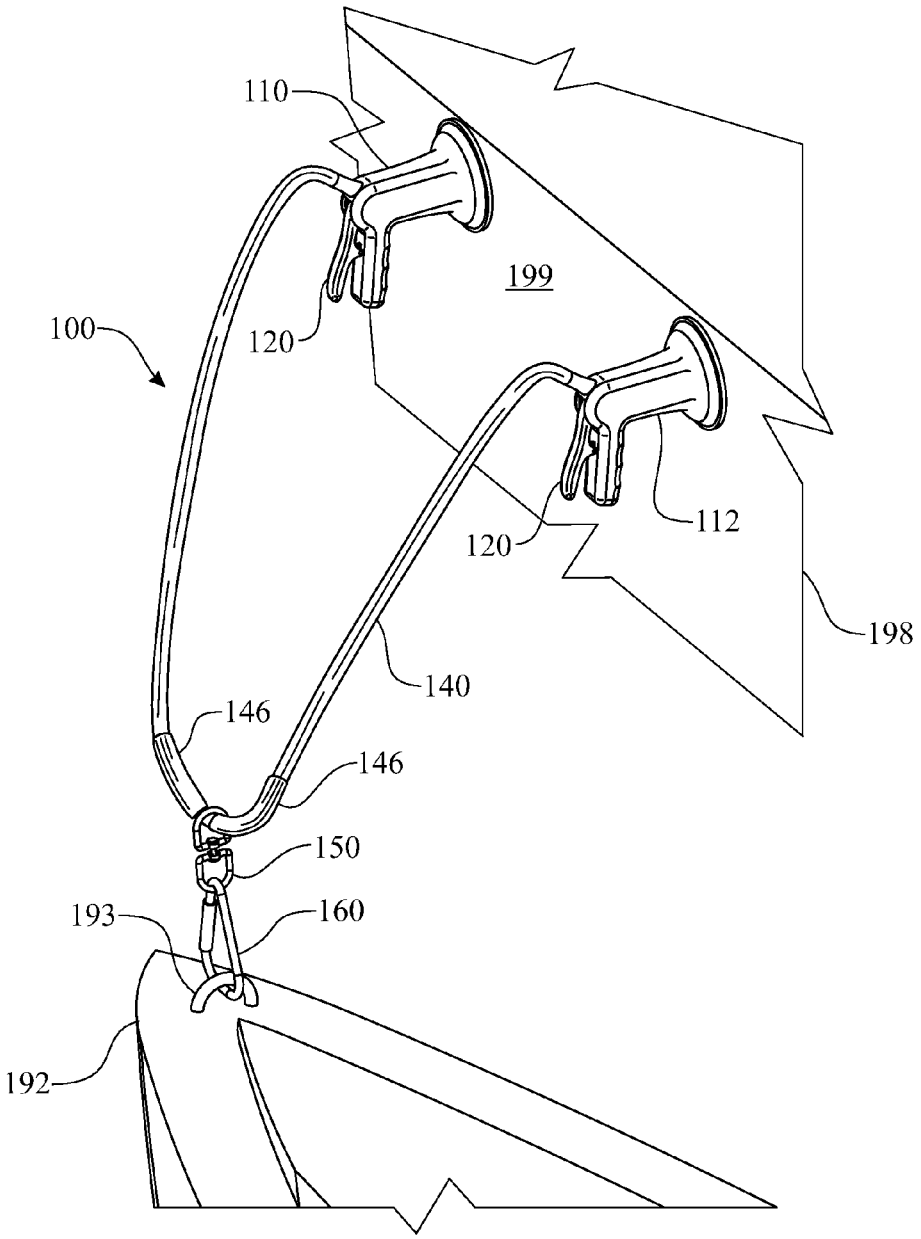
FIG. 4 presents an enlarged perspective view of the temporary mooring device engaging the hull of the host vessel and to which the bow of the dinghy is secured.

As best shown in one example of use of a pair of the temporary mooring devices 100, 101 in FIGS. 3-4, a small marine vessel in the form of a dinghy 190 is temporarily moored to a larger marine or host vessel 198 where a first temporary mooring device 100 is securing the bow 192 of the dinghy 190, and a second temporary mooring device 101 is securing the stern 194 of dinghy, to the outer hull surface 199 of the host vessel 198. It is understood that use of either of the devices 100, 101 with a dinghy 190 is not meant to limit the invention, as either one or both of the devices 100, 101 may be used to attach to a multitude of flotation devices. To accomplish the mooring, the link 160 of the first mooring device 100 is engaged with a mooring ring 193 permanently affixed to the bow 192 of the dinghy 190. The tube segments 146 closely received over the line 140 position the swivel 150 approximately at a mid-point of line 140. The first suction cup 110 is placed against the hull surface 199 of the host vessel 198 and the operating lever 120 is operably pivoted thereby affixing the first suction cup 110 to the hull surface 199. In like manner, the second suction cup 112 is placed against the hull surface 199 at a position that is laterally displaced from the position of the first suction cup 112 thereby temporarily mooring the bow 192 of dinghy 190 to the host vessel 198. In like manner, the second mooring device 101 is engagedly secured to the stern 194 of the dinghy 190 and the first and second suction cups 110, 112 are then engagedly affixed to the hull surface in a laterally spaced apart manner as the first mooring device 100 at the bow 192 of the dinghy 190. The dinghy 190 is now temporarily moored to the host vessel 198.

A dinghy or small vessel can be translated along a surface to which it is moored with at least one, and preferably the two, of the temporary mooring devices 100, 101 without totally disengaging the dinghy from the moored to surface. The method for so accomplishing the translation is schematically illustrated in a progressive manner in FIGS. 7-10. Utilizing the example of the dinghy 190 temporarily moored to the outer hull surface 199 of the host vessel 198 similar to that of FIGS. 3-4, the original midpoint of the dinghy 190 with respect to the host vessel 198 is represented by phantom line "X" in FIGS. 7-10 wherein FIG. 7 represents the starting position of the dinghy 190 which is desired to be translated from right to left.

Figure 7:
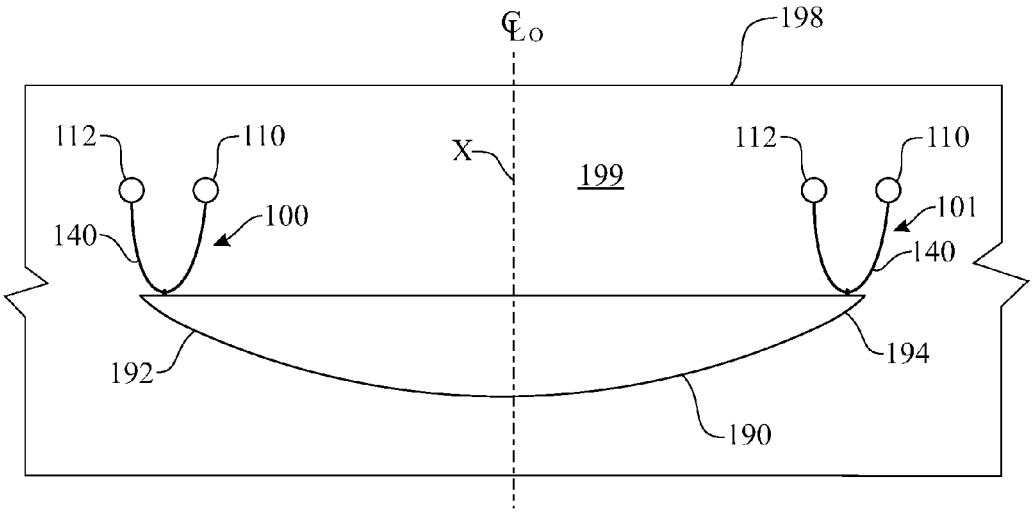
FIG. 7 presents a schematic first step of a method to translate a dinghy along the length of the hull of a host vessel while maintaining a temporary mooring to the host vessel.

In the starting position in FIG. 7 the dinghy 190 is secured to the outer hull surface 199 of host vessel 198 utilizing a first mooring device 100 securing the dinghy bow 192 and a second mooring device 101 securing the dinghy stern 194 to the host vessel 198. Each of the mooring devices 100, 101 includes a first suction cup 110, a second suction cup 112 and a length of line 140 in a manner as described previously herein.

Figure 8:
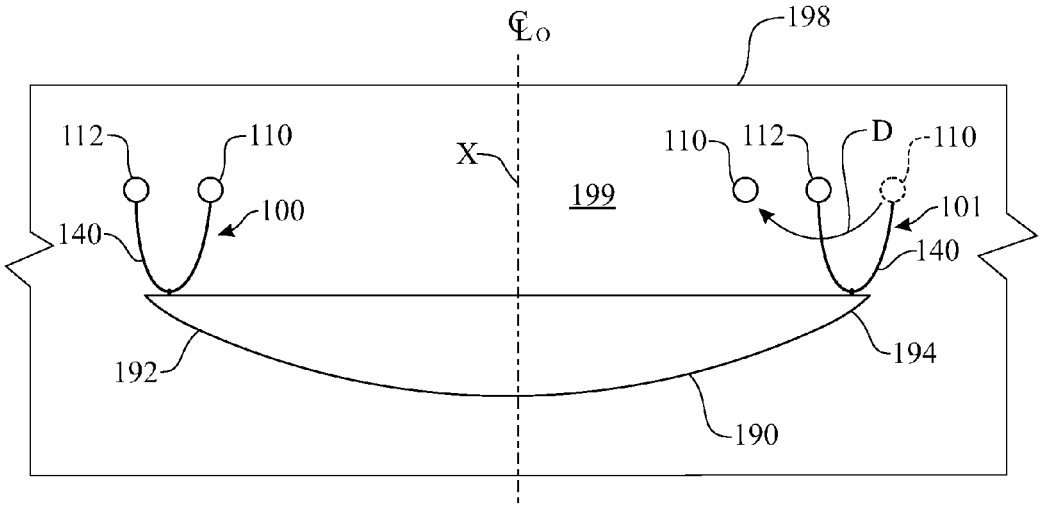
FIG. 8 presents a schematic second step of the translation method.

Referring now to FIG. 8, the first suction cup 110 of the second mooring device 101 at the stern 194 of the dinghy 190 is released from the hull surface 199 and translated from an initial position being laterally to the right of the second suction cup 112 to a position laterally to the left of the second suction cup 112 in a leap-frog manner, as indicated by an arrow "D." The second suction cup 112 of the second mooring device 101 remains in its initial position engaged with the hull surface 199. The swivel 150 (FIG. 1) facilitates the rotation of link 160 with respect to the line 140 thereby preventing the entanglement and twisting of the line 140 that would occur if the link 160 could not rotate with respect to the line 140.

Figure 9:
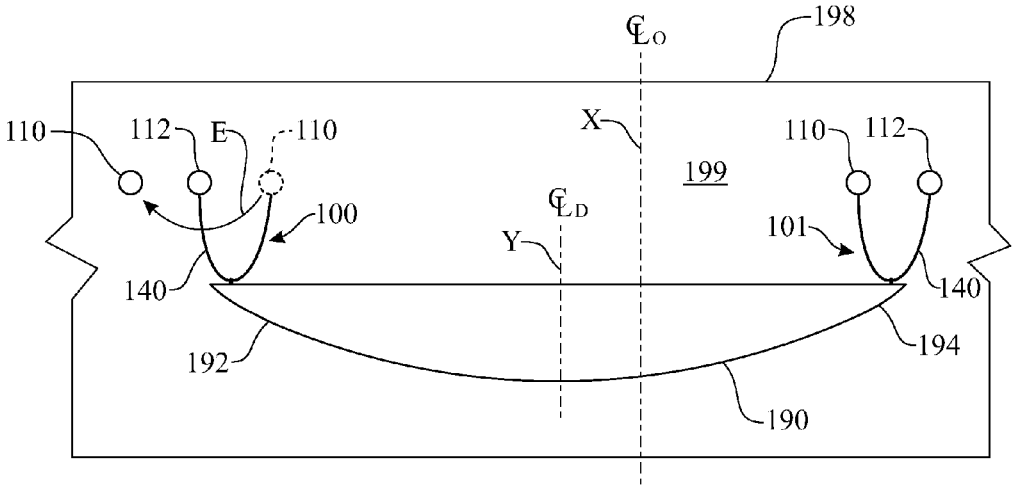
FIG. 9 presents a schematic third step of the translation method.

Referring now to FIG. 9, the first suction cup 110 of the first mooring device 100 at the bow of dinghy 190 is released from the hull surface 199 and translated from an initial position being laterally to the right of the second suction cup 112 to a position laterally to the left of the second suction cup 112 in the same leap-frog manner, as indicated by an arrow "E." The second suction cup 112 of the first mooring device 100 remains in its initial position engaged with the hull surface 199. The effective fore and aft mooring points with respect to the hull surface 199 have now horizontally translated to the left from phantom vertical line "X" to phantom vertical line "Y," thus translating dinghy 190 to the left a distance equal to the distance between phantom lines "X" and "Y."

Figure 10:
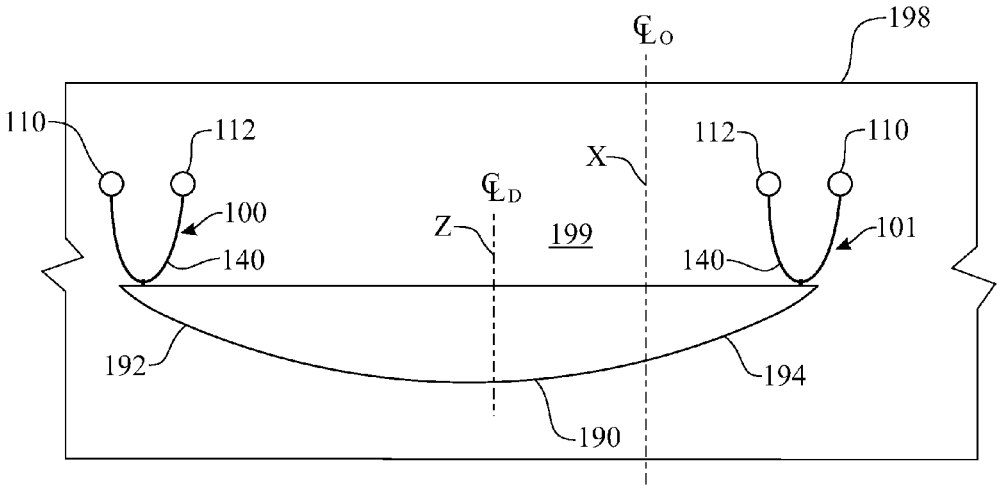
FIG. 10 presents a schematic fourth step of the translation method.

The process is continued, as indicated in FIG. 10, wherein the first suction cups 110 of both the mooring devices 100, 101 at the bow 192 and stern 194 of dinghy 190 respectively, are again "leap-frogged" from the right of second suction cups 112 to a position to the left of second suction cups 112 thereby translating the midpoint of dinghy 190 to correspond to phantom line "Z", roughly twice the distance between positions "X" and "Y." The process can be continued to effectively translate the dinghy 190 along the entire length of hull surface 199 and, for that matter, can even facilitate circumnavigation of the entire hull of host vessel 198. Those practiced in the art will readily recognize that the method of translating dinghy 190 with respect to the host vessel 198 can be accomplished in a left to right manner as well as a right to left manner depending on the desire and need of the operator in dinghy 190.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What I claim is:

1. A method of translating a small marine vessel along a substantially smooth surface, said method comprising the steps:

providing first and second temporary mooring devices each having first and second selectively engagable suction cups, and a line interconnecting the suction cups one with the other;

securing the line of the first mooring device proximate to a bow of the small vessel;

affixing the first and second suction cups of the first mooring device to the substantially smooth surface in a laterally spaced apart configuration;

securing the line of the second mooring device to a stern of the small vessel;

affixing the first and second suction cups of the second mooring device to the substantially smooth surface in a laterally spaced apart configuration;

releasing the first of the suction cups of the first mooring device from the substantially smooth surface;

translating the first suction cup of the first mooring device laterally along the substantially smooth surface in a manner to leap-frog the second suction cup to be laterally spaced from the second suction cup on an opposite side of the second suction cup;

re-affixing the first suction cup of the first mooring device to the substantially smooth surface;

releasing the first of the suction cups of the second mooring device from the substantially smooth surface;

translating the first suction cup of the second mooring device laterally along the substantially smooth surface in a manner to leap-frog the second suction cup to be laterally spaced from the second suction cup on an opposite side of the second suction cup; and re-affixing the first suction cup of the second mooring device to the substantially smooth surface.

2. The translation method of claim 1 further including the step:

repeating the alternating leap-frog translations utilizing the second suctions cups of the first and second mooring devices.

3. The translation method of claim 1 wherein the providing step the line is a shock cord.

4. The translation method of claim 1 wherein the providing step at least one of the first and second temporary mooring devices has a selectively releasable link engaging the line at a location being generally intermediate between the first and second suction cups.

5. The translation method of claim 4 wherein the selectively releasable link is a carabiner.

6. The translation method of claim 4 wherein the selectively releasable link secures the line to the small marine vessel.

7. The translation method of claim 4 further wherein the providing step at least one of the first and second temporary mooring devices has a swivel engaged on the line at the location being generally intermediate between the first and second suction cups and further wherein the selectively releasable link engages the swivel and is pivotable with respect to the line.

8. The translation method of claim 7 wherein the swivel is selectively maintained in the intermediate position by first and second tube segments circumscribing the line at respective opposite sides of the swivel.

* * * * *